US006200243B1

(12) United States Patent
Meranto

(10) Patent No.: US 6,200,243 B1
(45) Date of Patent: Mar. 13, 2001

(54) USER ADJUSTABLE WEIGHT DEVICE WITH AUDIO OR TALKING CAPABILITIES

(76) Inventor: Samuel R. Meranto, 4128 E. Monte Vista, Phoenix, AZ (US) 85008

( * ) Notice: Subject to any disclaimer, the term of this patent is extended or adjusted under 35 U.S.C. 154(b) by 0 days.

(21) Appl. No.: 09/247,498

(22) Filed: Feb. 10, 1999

(51) Int. Cl.[7] ..... A63B 21/06

(52) U.S. Cl. ..... 482/105; 482/1; 482/74; 224/148.4; 150/150

(58) Field of Search ..... 482/74, 105; 224/196, 224/587, 148.1–148.7; 150/150–153; 2/311, 338, 321

(56) References Cited

U.S. PATENT DOCUMENTS

| | | | | |
|---|---|---|---|---|
| 3,601,815 | * | 8/1971 | Strehlan | 150/150 |
| 3,659,843 | | 5/1972 | Kojigian, Jr. . | |
| 3,797,010 | * | 3/1974 | Adler et al. | 482/79 |
| 3,861,675 | | 1/1975 | Hopper . | |
| 4,021,035 | | 5/1977 | O'Hara . | |
| 4,139,130 | * | 2/1979 | Glusker et al. | 224/148.1 |
| 4,268,917 | * | 5/1981 | Massey | 782/105 |
| 4,612,917 | | 9/1986 | Kesler . | |
| 4,854,572 | | 8/1989 | Knight . | |
| 4,911,439 | | 3/1990 | Kuhl . | |
| 4,946,453 | | 8/1990 | Monson | 604/312 |
| 4,988,097 | * | 1/1991 | Smith et al. | 482/105 |
| 5,129,647 | | 7/1992 | Castellanos | 482/124 |
| 5,362,295 | | 11/1994 | Nurge | 482/124 |
| 5,484,366 | * | 1/1996 | Wilkinson | 482/105 |
| 5,555,562 | | 9/1996 | Holt et al. | 2/69 |

* cited by examiner

*Primary Examiner*—John Mulcahy
(74) *Attorney, Agent, or Firm*—Steven Lin

(57) ABSTRACT

User adjustable weight device 10 is worn by a user for applying weight to the user. Weight device 10 comprises a strap portion 12 and weight roll pockets 14. Rolls of weights 16 are inserted into and removed from the weight roll pockets 14 so that a desired amount of weight is controlled, adjusted, and achieved by the user as desired. Weight device 10 further has a fluid containing device 24 with a fluid inlet 26. Fluid containing device 24 receives and holds fluid filled by the user through the fluid inlet 26. Fluid is filled into or removed from the fluid containing device 24 so that a desired amount of weight is controlled, adjusted, and achieved by the user as desired. An audio unit 30 is coupled to the strap portion 12 wherein the audio unit 30 is able to play and/or record information. A storage pocket 40 is coupled to the strap portion 12 wherein the storage pocket 40 stores various items. A user grasping portion 50 is coupled to the strap portion 12 wherein the user grasping portion 50 is able to be grasped by the user for using the weight device as a weapon. A securing device is coupled to the strap portion 12 for securing the weight device to the user. The weight device 10 is able to be used for one or more applications such as an exercise or weight loss device and/or a stress relief device and/or a weapon and/or a water/fluid container.

18 Claims, 4 Drawing Sheets

USER ADJUSTABLE WEIGHT DEVICE WITH AUDIO OR TALKING CAPABILITIES

FIELD OF INVENTION

The present invention relates to a weight device, and, in particular, to a user adjustable weight device with audio or talking capabilities.

BACKGROUND OF INVENTION AND BRIEF DESCRIPTION OF THE PRIOR ART

Various weighted devices exist in the prior art. Some of these weighted devices have been designed for exercise or weight loss. These devices may be designed to be worn by the user on some part of his/her body. Examples of such weighted devices are disclosed in the following prior art patents: U.S. Pat. Nos. 4,344,620; 4,384,369; 4,180,261; 3,751,031; 4,676,502; 4,896,879; 4,905,991; 5,487,498. These prior art patents are incorporated by reference herein.

These prior art weighted devices appear to be designed for specific parts of the body, and they appear to not be designed to be adapted for use on multiple parts of the body. Therefore, the prior art devices are very limited in use and versatility, and the user would have to obtain a number of devices to use on various parts of his/her body. Furthermore, some of the prior art devices do not allow the user to adjust the amount of weight within the device, and some of the devices have specialized weight components. Therefore, some of these devices require specially purchased weights to be used therewith and do not allow the user to use common weighted items to adjust the weight of the device. Also, the prior art devices typically either teach the use of solid weights or the use of liquid weights. None of the devices appear to have taught using a combination of either or both solid and liquid weights for allowing the user to adjust the weight of the device. A weighted device that uses common weighted items, that is versatile, and that has multiple applications and uses is needed and desired.

Weighted devices for stress relief exist in the prior art. These devices are designed to be placed on body parts of the user, and the application of the weights provides a stress relieving effect to the user. However, these stress relieving weighted devices are typically not designed to be also used as a device for exercise or weight loss as well. Such a device is needed and desired.

Furthermore, exercisers, joggers, hikers, or other such persons may use weighted devices while they are in the outdoors. However, these exercisers, joggers, hikers, or other such persons may be at risk or vulnerable to attack while being outdoors. Therefore, there is a need and desire to adapt the weighted devices to be used as weapons as well. Also, these exercisers, joggers, hikers, or other such persons may suffer from dehydration while being outdoors or at locations where water may not be readily available. Therefore, these persons may have to carry additional equipment for holding water which may interfere with their activities. Therefore, a weighed device that incorporates the ability of allowing these persons to also carry water with them and that does not interfere with their activities is needed and desired.

Furthermore, devices with audio play and/or record capabilities exist. However, a weighted device used for exercise, weight loss, stress, or as a weapon that has audio capabilities appears to not exist. In particular, audio messages related in some way to the user or to the manner and use of the weighted device have not been provided by the prior art devices. Therefore, there is a need and desire for such a device.

Therefore, the present invention discloses and provides a user adjustable weight device with audio or talking capabilities which may be used as a exercise/weight loss device and/or a stress relief device and/or a weapon and/or a water container, and the present invention overcomes the problems, disadvantages, and limitations of the prior art.

SUMMARY OF INVENTION

Set forth is a brief summary of the invention in order to solve the foregoing problems and achieve the foregoing and other objects, benefits, and advantages in accordance with the purposes of the present invention as embodied and broadly described herein.

It is an object of the invention to provide a weight device that is worn by the user wherein the weight of the weight device is able to be adjusted by the user.

It is another object of the invention to provide a weight device that is able to be worn on various body parts of the user and that is versatile in use.

It is a further object of the invention to provide a weight device that allows the user to use common weighted items as weights for the device.

It is another object of the invention to provide a weight device that allows the user to use either solid weights or fluid/liquid weights or both as weights for the device.

It is a further object invention to provide a weight device that is able to be used for one or more applications such as an exercise or weight loss device and/or a stress relief device and/or a weapon and/or a water container.

It is another object of the invention to provide a weight device that has audio play and/or record capabilities.

It is still another object of the invention to provide a weight device that is adjustable and versatile and has audio capabilities.

It is still a further object of the invention to provide the above weight device that has further storage capabilities.

The above objects and advantages of the invention are achieved by a user adjustable weight device that is worn by a user for being able to apply weight to the user. The weight device comprises a strap portion and weight roll pockets. The strap portion is able to be worn by at least one body part of the user. The weight roll pockets are attached to the strap portion, and the weight roll pockets are able to receive and hold rolls of weights that are inserted by the user. The strap portion is or has a pouch with a securable opening. The weight roll pockets are located and coupled within the pouch and accessible by the user through the securable opening to be able to insert the rolls of weights therein. The securable opening of the pouch is secured by at least one fastening device. The at least one fastening device may be a hook and loop fastener device.

The weight roll pockets may be located and coupled at an exterior or interior portion of the pouch wherein the user is able to insert the rolls of weights therein. The weight roll pockets are configured to receive and hold rolls of coins/pennies, magnets, washers, or other such items. The weight device further has a fluid containing device with a fluid inlet. The fluid containing device is attached to the strap portion and is able to receive and hold fluid filled by the user through the fluid inlet. The fluid containing device is generally located within the pouch, and the fluid inlet is accessible by the user through the securable opening to be able to insert fill the fluid therein. An audio unit is coupled to the strap portion wherein the audio unit is able to play and/or record information. A storage pocket is coupled to the strap portion wherein the storage pocket stores various items. A user grasping portion is coupled to the strap portion wherein the user grasping portion is able to be grasped by the user for using the weight device as a weapon. A securing device is coupled to the strap portion for securing the weight device to the user.

The above objects and advantages of the invention are also achieved by a user adjustable weight device that is worn by a user for being able to apply weight to the user wherein the weight device has a strap portion, weight roll pockets, and a fluid containing device. The strap portion is able to be worn by at least one body part of the user. The weight roll pockets are attached to the strap portion. The weight roll pockets are able to receive and hold rolls of weights that are inserted by the user. The fluid containing device has a fluid inlet. The fluid containing device is attached to the strap portion, and the fluid containing device is able to receive and hold fluid filled by the user through the fluid inlet. The weight device may have an audio unit and/or a storage pocket and/or a user grasping portion.

The above objects and advantages of the invention are further achieved by a method of using a user adjustable weight device that is worn by a user for being able to apply weight to the user. The weight device is provided with a strap portion that is able to be worn by at least one body part of the user and weight roll pockets attached to the strap portion wherein the weight roll pockets are able to receive and hold rolls of weight that are inserted by the user. A desired amount of the rolls of weight is/are inserted into the weight roll pockets. The strap portion is worn with the desired amount of the rolls of weight at a desired body part of the user.

A fluid containing device may be provided having a fluid inlet wherein the fluid containing device is attached to the strap portion. The fluid containing device is able to receive and hold fluid filled by the user through the fluid inlet. A desired amount of the fluid is filled into the fluid containing device. An audio unit may be coupled to the strap portion wherein the audio unit is able to play and/or record information. A securing device is coupled to the strap portion for securing the weight device to the user. The strap portion may be worn at various body parts of user such as the waist, neck, limb, arm, ankle, wrist, etc.

The above objects and advantages of the invention are also achieved by an audio adjustable weight device that is worn by a user for being able to apply weight to the user. The audio adjustable weight device has a strap portion and an audio unit. The strap portion has a weight retaining area wherein the user is able to place a desired amount of weight. The audio unit is coupled to the strap portion wherein the audio unit is able to play and/or record information.

The preferred embodiments of the inventions are described below in the Figures and Detailed Description. Unless specifically noted, it is intended that the words and phrases in the specification and claims be given the ordinary and accustomed meaning to those of ordinary skill in the applicable art or arts. If any other meaning is intended, the specification will specifically state that a special meaning is being applied to a word or phrase. Likewise, the use of the words "function" or "means" in the Detailed Description is not intended to indicate a desire to invoke the special provisions of 35 U.S.C. Section 112, paragraph 6 to define the invention. To the contrary, if the provisions of 35 U.S.C. Section 112, paragraph 6, are sought to be invoked to define the inventions, the claims will specifically state the phrases "means for" or "step for" and a function, without also reciting in such phrases any structure, material, or act in support of the function. Even when the claims recite a "means for" or "step for" performing a function, if they also recite any structure, material or acts in support of that means of step, then the intention is not to invoke the provisions of 35 U.S.C. Section 112, paragraph 6. Moreover, even if the provisions of 35 U.S.C. Section 112, paragraph 6, are invoked to define the inventions, it is intended that the inventions not be limited only to the specific structure, material or acts that are described in the preferred embodiments, but in addition, include any and all structures, materials or acts that perform the claimed function, along with any and all known or later-developed equivalent structures, materials or acts for performing the claimed function.

DETAILED DESCRIPTION

Figure 1:
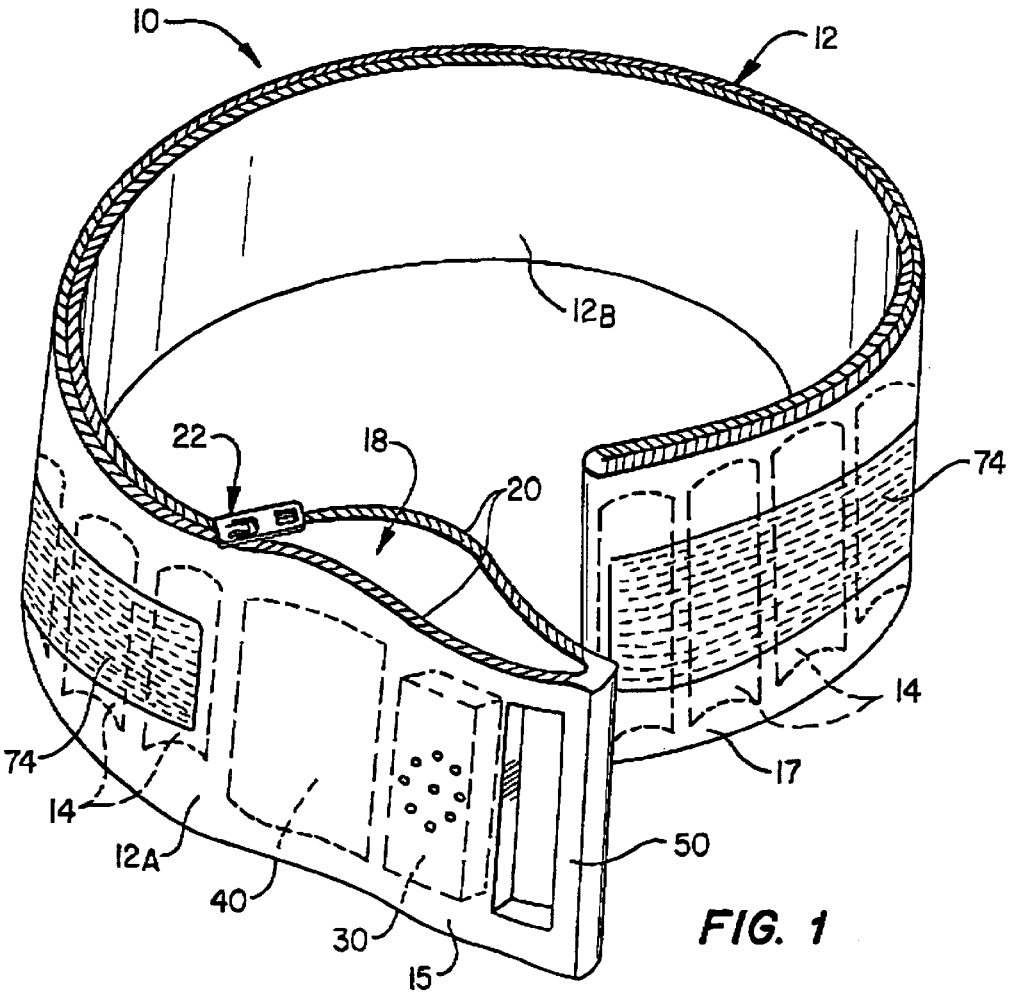
FIG. 1 is a perspective view of a preferred embodiment of the present invention user adjustable weight device with audio or talking capabilities.
Figure 2:
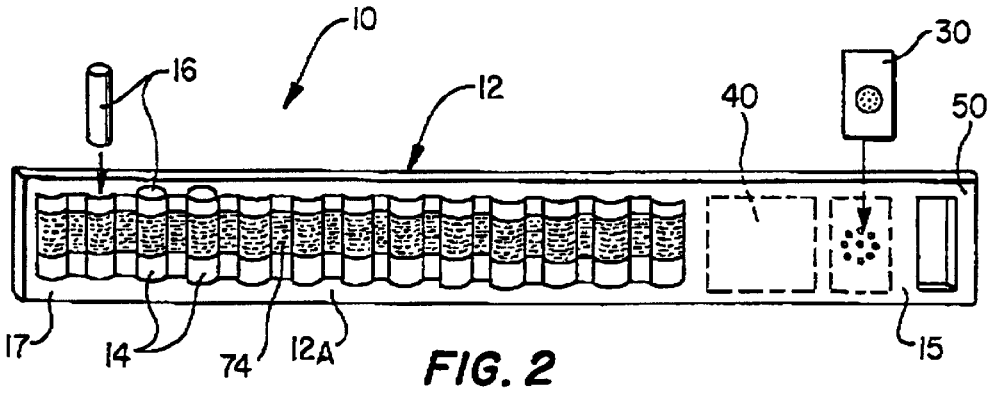
FIG. 2 is a side view of an alternative embodiment present invention device wherein the weight roll pockets are shown at an exterior portion of the strap portion.
Figure 3:
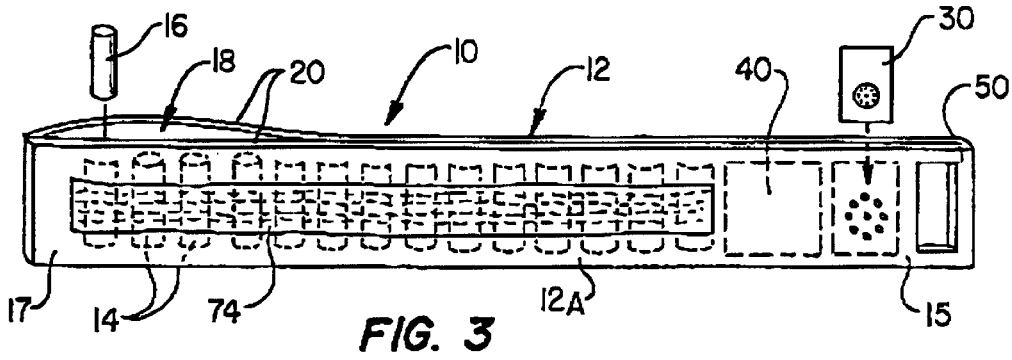
FIG. 3 is a side view of the present invention device according to FIG. 1 wherein the weight roll pockets are shown at an interior portion of the strap portion.

The present invention is a user adjustable weight device 10 with audio or talking capabilities. The weight device 10 is worn by a user for being able to apply weight to various body parts of the user. FIG. 1 shows that the weight device 10 generally has an elongated strap portion 12 and weight roll pockets 14. The elongated strap portion 10 is able to be worn by the user at one or more of his/her body part(s). The weight roll pockets 14 are attached to the strap portion 12. FIG. 2 shows that the weight roll pockets 14 are attached to an exterior portion 12A of the strap portion 12. Alternatively, FIG. 3 shows that the weight roll pockets 14 are attached inside the pouch area 18 of strap portion 12. The weight roll pockets 14 are able to receive and hold rolls of weights 16, such as rolls of coins/pennies, magnets, copper, washers, or any other such suitable weights. These rolls of weights 16 are inserted and removed by the user, and the desired amount of rolls of weights 16 are, therefore, able to be controlled and adjusted by the user as desired. For example, if the user wishes to wear a relatively heavy weight device 10, then he/she would insert a large/larger number of roll(s) of weights 16 into respective weight roll pockets 14. On the other hand, if the user wishes to wear a relatively light weight device 10, then he/she would insert a small/smaller number of roll(s) of weights 16 into respective weight roll pockets 14. Therefore, the user may fill all of the pockets 14 with rolls of weights 16 or just some of the pockets 14 with rolls of weights 16.

In FIG. 2, the user simply inserts rolls of weights 16 as desired in the exterior weight roll pockets 14. The strap portion 12 has a pouch area 18 with a securable opening 20. In FIG. 3, the weight roll pockets 14 are alternatively located and attached inside the pouch area 18. The pouch area 18 is accessible by the user through the securable opening 20 to be able to insert the rolls of weights 16 therein. The securable opening 20 of the pouch area 18 is secured by at least one fastening device 22, such as the zipper shown in FIG. 1 or strips of VELCRO™ hook and loop fasteners.

Figure 4:
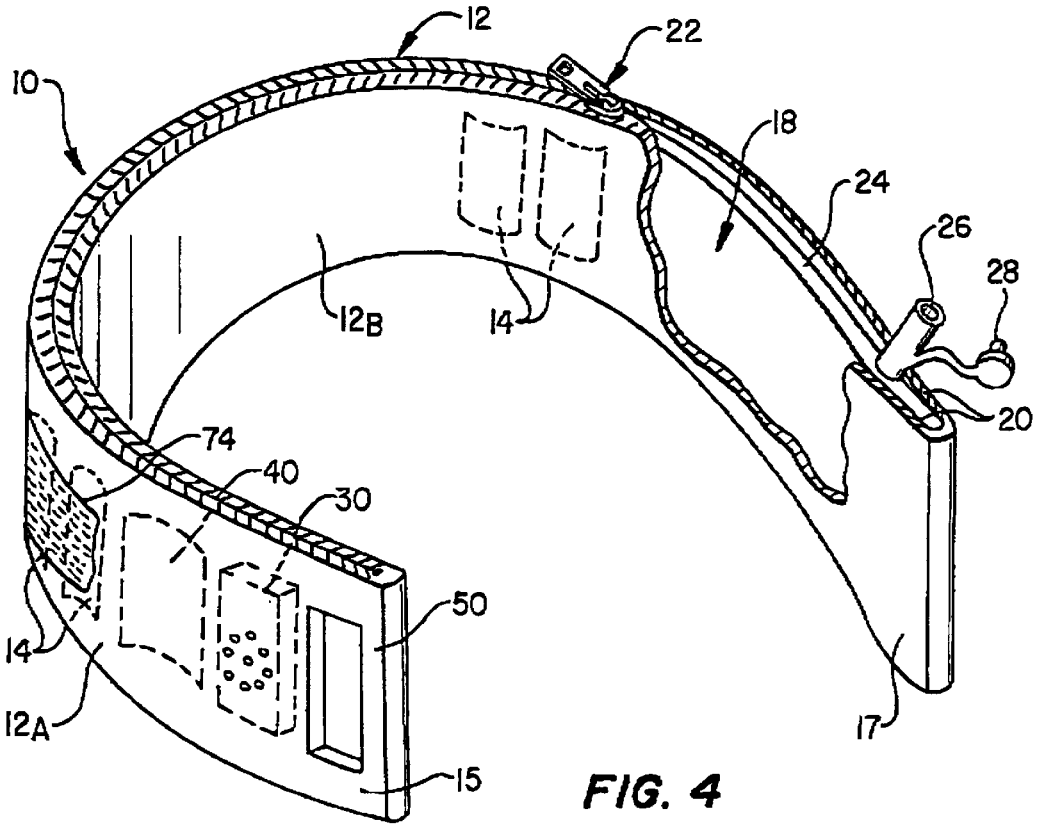
FIG. 4 is a perspective view of the present invention device according to FIG. 1 wherein the device further has a fluid containing device or pocket for holding fluid as weight.

FIG. 4 shows the same weight device 10 as shown in FIG. 1 except that the weight device 10 further has a fluid containing device 24. The fluid containing device 24 has a fluid opening 26 with a sealable mechanism 28. The fluid containing device 24 holds fluid therein wherein the fluid is used as weight for the weight device 10. The fluid containing device 24 is generally located within the pouch area 18. The device 24 may be located or attached within the pouch area 18. The fluid opening 26 and sealable mechanism 28 is able to protrude from the pouch area 18 through the securable opening 20. The fluid opening 26 allows the user to fill fluid therein or remove fluid thereout. The sealable mechanism 28 prevents fluid from being removed from the device 24 when in the closed position and allows access of the device 24 when in the open position. For example, if the user wishes to wear a relatively heavy weight device 10, then he/she would fill or maintain the device 24 with a large/larger amount of fluid. On the other hand, if the user wishes to wear a relatively light weight device 10, then he/she would fill or maintain the device 24 with a small/smaller amount of fluid. The fluid contained in the device 24 may be drinkable water or other drinkable fluids, and, therefore, the user would be able to drink the water/fluids from the fluid opening 26 as needed and desired. This feature is particularly advantageous if the user is in an emergency or urgent situation in which he/she needs water/fluids and the user does not have to carry additional/separate containers or equipment.

Figure 9:
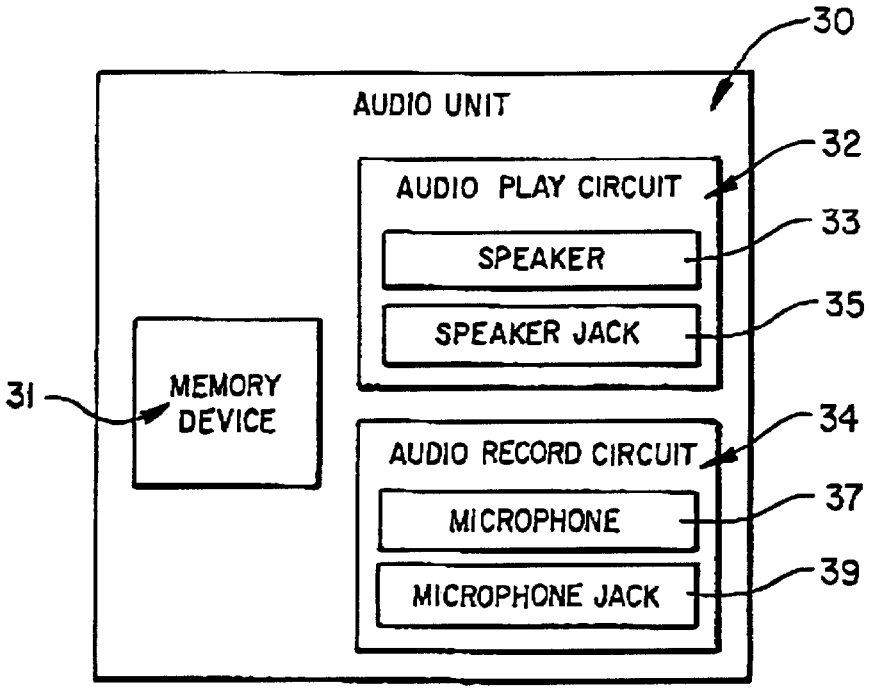
FIG. 9 is a block diagram of the audio unit used with the present invention device.

Furthermore, the present weighted device 10 shown in FIGS. 1, 1A, 2, 3 and 4 has an audio unit 30 located therein. The audio unit 30 is coupled inside the strap portion 12 at an end 15, or it may be coupled to any other suitable location of weight device 10. Referring to FIG. 9, the audio unit 30 has at least an audio play circuit 32 with a speaker 33 or a speaker jack 35 and an audio record circuit 34 with a microphone 37 or microphone jack 39 and a memory device 31. The audio play circuit 32 allows the audio unit 30 to play audio information from the memory device 31 while the audio record circuit 34 allows the audio unit 30 to record audio information to the memory device 31. In particular, audio messages related in some way to the user or to the manner and use of the weight device 10 is able to be provided by the audio unit 30. For example, encouragement messages, such as the phrase(s) "Lose Weight" or "Keep Going" or "You Can Do It", are able to be recorded by the audio record circuit 34 through the microphone 37 and played to the user by the audio play circuit 32 through the speaker 33. Also, warning messages, such as "Help" or "Emergency", are able to be recorded by the audio record circuit 34 and played by the audio play circuit 32. Furthermore, the audio record circuit 34 may be used to record information related to an attack on the user. Also, the audio unit 30 may be set up to allow the user to play music or other entertaining sounds. Additionally, the audio unit 30 may be activated automatically or manually. If activated manually, a manual switch (not shown) would be provided for such activation. If activated automatically, the audio unit 30 may be configured to self activate based on light (lamp light, daylight, etc.), motion (movement of the user, etc.), or other such suitable automatic triggering forces. For example, the audio unit 30 may provide encouraging messages in the morning time when light hits the weight device 10 or when the user wearing the weight device 10 begins to exercise.

Figure 10:
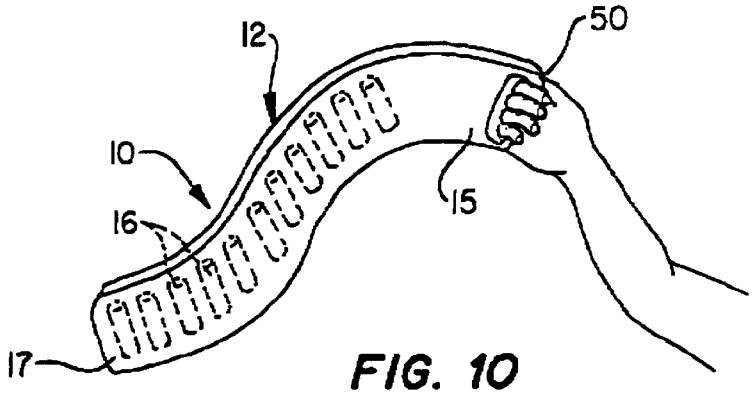
FIG. 10 is a perspective of the present invention device being used as a weapon.

Referring to FIGS. 1, 1A, 2, 3, and 4, a storage pocket 40 is coupled inside the strap portion 12 at end 15. The storage pocket 40 may also be coupled to the strap portion 12 at any suitable location. The storage pocket 40 holds or stores various items, such as wallets, keys, sunglasses, money, medication, cellular phones, pagers, etc. The storage pocket 40 has a securing device 42, such as the zipper shown in FIG. 1A or strips of VELCRO™ hook and loop fastener. Also, these figures show a user grasping portion 50 that is made part of the weight device 10. The user grasping portion 50 is coupled to the strap portion 12 at end 15. The user grasping portion 50 is able to be grasped by the user and allows the user to use or swing the weight device 10 as a weapon as shown in FIG. 10. In situations in which the weight device 10 is being worn by the user, the user grasping portion 50 allows the user to easily and quickly grip and tear the weight device 10 from his/her body and use it as a weapon. In one preferred method of use, if a user desires to only partially fill the weight roll pockets 14 with rolls of weights 16, then the user would locate and concentrate the rolls of weights 16 towards end 17 of the strap portion 12 so that a more effective weapon is provided. This feature is particularly advantageous if the user is in an emergency or urgent situation in which he/she needs some type of weapon and it allows the user to have a weapon readily available without having to carry additional/separate items or equipment.

Figure 1A:
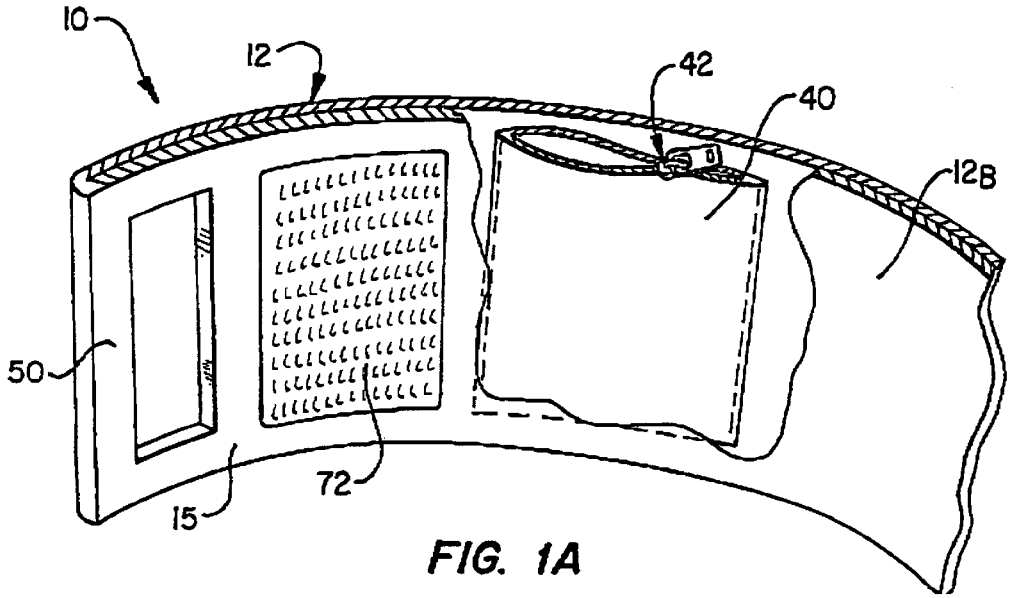
FIG. 1A is a partial back perspective view of the adjustable weight device according to FIG. 1.

The user adjusts the weight of the weight device 10 to a desired amount by either inserting rolls of weights 16 into the weight roll pockets 14 or filling fluid into the fluid containing device 24. The user places the weight device 10 at a desired body part. Referring to FIGS. 1 and 1A, a securing device having a hook fastener portion 72 and a loop fastener portion 74 is coupled to the strap portion 12. The hook fastener portion 72 is located on side 12B towards end 15 of the strap portion 12 as shown in FIG. 1A while the loop fastener portion 74 is located along side 12A of the strap portion 12 as shown in FIG. 1. The loop fastener portion 74 may be a continuous strip extending generally from end 17 towards end 15 of the strap portion 12 or may be a multiple number of strips that are located at various locations from end 17 towards end 15 of the strap portion 12. The user uses the securing device to secure the weight device 10 to him/her. As one preferred embodiment, the loop fastener portion 74 may be made an integral part of or coupled to the exterior portions of the weight roll pockets 14 that span the length or lengths of the strap portion 12 as shown in FIG. 1.

Figure 5:
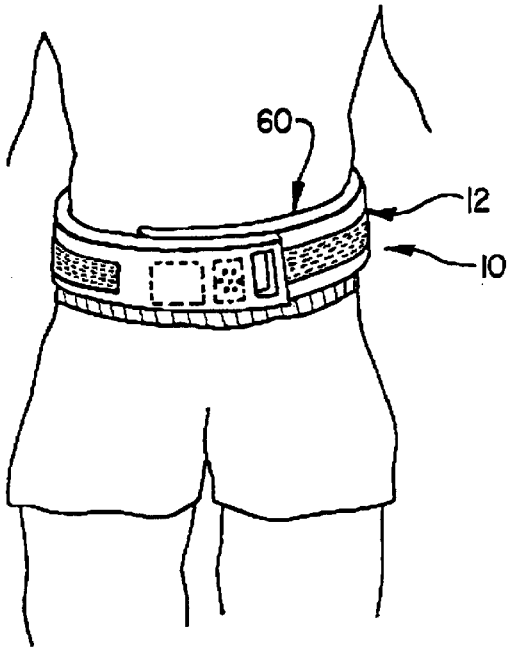
FIG. 5 is a perspective view of the present invention device being used around a user's waist.
Figure 6:
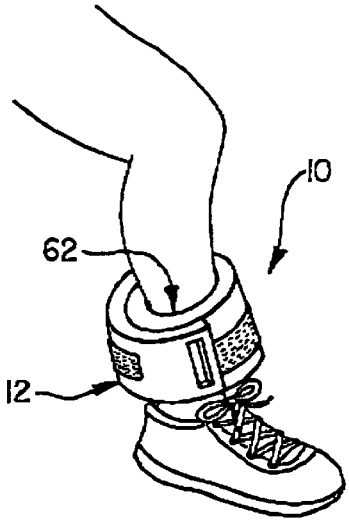
FIG. 6 is a perspective view of the present invention device being used around a user's ankle.
Figure 7:
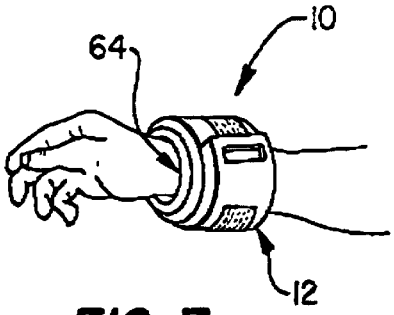
FIG. 7 is a perspective view of the present invention device being used around a user's wrist.

FIGS. 5 to 8 show some examples of how the present weight device 10 is used by and secured to the user. FIG. 5 shows the user wearing the strap portion 12 of the weight device 10 around a waist area 60 of the user. The weight device 10 is used as a belt by placing the strap portion 12 around the waist area 60. The strap portion 12 is secured thereto by overlapping the hook fastener portion 72 over the loop fastener portion 74. The weight device 10 allows pressure to be applied to the waist area of the user which provides a general weight burning effect at the waist and waist line area. FIGS. 6 and 7 show the user wearing the strap portion 12 around a limb of the user. FIG. 6 shows the strap portion 12 wrapped around an ankle 62 of the user. The strap portion 12 is secured by overlapping the hook fastener portion 72 over the loop fastener portion 74 after being wrapped around the ankle 62. FIG. 7 shows the strap portion 12 wrapped around a wrist 64 of the user. The strap portion 12 is secured by overlapping the hook fastener portion 72 over the loop fastener portion 74 after being wrapped around the wrist 64. FIGS. 5 to 7 generally show the use of the weight device 10 as an exercise or weight loss device.

Figure 8:
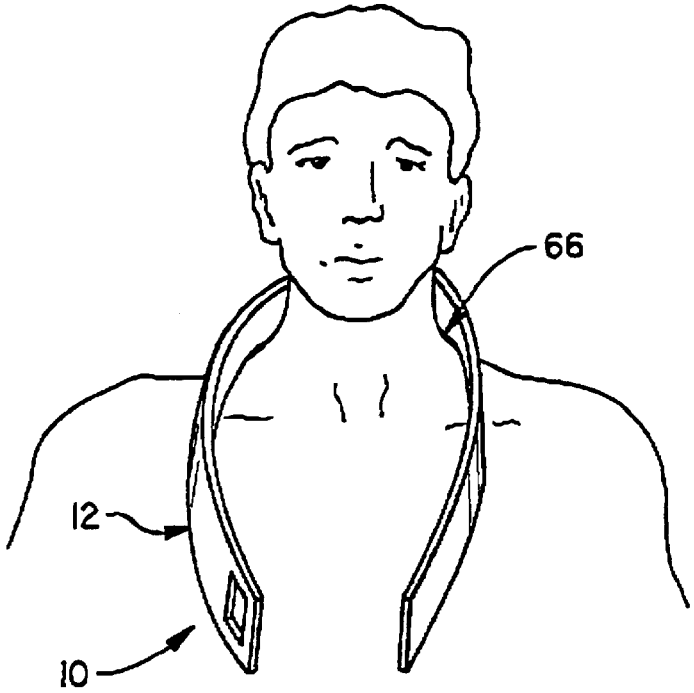
FIG. 8 is a perspective view of the present invention device being used around a user's neck.

FIG. 8 shows the user using the weight device 10 as a scarf by wearing the strap portion 12 of the weight device 10 around a neck or shoulder area 66 of the user. The strap portion 12 is placed around the neck or shoulder area 66. The weight device 10 hangs around the user's neck or shoulders, and it may be further secured by overlapping the hook fastener portion 72 over the loop fastener portion 74. FIG. 8 shows the weight device 10 being used as a stress relief device.

In the above applications and uses, a preferred method of use of the weight device 10 is to use copper or magnets as the rolls of weights 16 to be inserted into the weight roll pockets 14 since copper and magnets are known or alleged to provide further healing properties and effects to people in general. The weight device 10 provides a device to the user that is initially and generally empty of weights and allows the user to place or adjust the weight of the weight device to desired amounts by inserting and/or removing common weighted items. Therefore, the weight device 10 is able to be used for one or more applications such as an exercise or weight loss device and/or a stress relief device and/or a weapon and/or a water/fluid container.

The preferred embodiment of the invention is described above in the Figures and Detailed Description. Unless specifically noted, it is the intention of the inventor that the words and phrases in the specification and claims be given the ordinary and accustomed meanings to those of ordinary skill in the applicable art(s). The foregoing description of a preferred embodiment and best mode of the invention known to applicant at the time of filing the application has been presented for the purposes of illustration and description. It is not intended to be exhaustive or to limit the invention to the precise form disclosed, and many modifications and variations are possible in the light of the above teaching. The embodiment was chosen and described in order to best explain the principles of the invention and its practical application and to enable others skilled in the art to best utilize the invention in various embodiments and with various modifications as are suited to the particular use contemplated. Also, the present invention is not in any way limited to the specific embodiments or configurations presented in this specification.

What is claimed is:

1. An exercise weight device comprising:

a strap portion comprising an elongate pouch having a securable opening along the length thereof for accessing the interior thereof;

a fastening device for securing the opening;

weight roll pockets along the length of the strap portion inside the pouch for receiving and holding rolls of weights;

at least one additional pocket inside the pouch;

a securing device for securing one end portion of the strap portion to the opposite end portion about a user's body part; and a user grasping portion comprising an elongate through hole along one end of the strap portion for accommodating the user's hand in order to use the device as a weapon.

2. The weight device according to claim 1 wherein the at least one fastening device is a hook and loop fastener device.

3. The weight device according to claim 1 wherein the weight roll pockets are configured to receive and hold rolls of coins.

4. The weight device according to claim 1 wherein the weight roll pockets are configured to specifically receive and hold rolls of pennies.

5. The weight device according to claim 1 further comprising:

a fluid containing device having a fluid inlet wherein the fluid containing device is attached to the strap portion and is able to receive and hold fluid filled by the user through the fluid inlet.

6. The weight device according to claim 5 wherein the fluid containing device is generally located within the pouch and the fluid inlet is accessible by the user through the securable opening to be able to fill fluid therein.

7. The weight device according to claim 1 further comprising:

an audio unit coupled to the strap portion wherein the audio unit is able to play information.

8. The weight device according to claim 7 wherein the audio unit is further able to record information.

9. The weight device according to claim 7 wherein the audio unit is automatically activated when motion is sensed.

10. The weight device according to claim 7 wherein the audio unit is automatically activated when light is sensed.

11. A method of exercising comprising the steps of:

providing an exercise weight device comprising: a strap portion comprising an elongate pouch having a securable opening along the length thereof for accessing the interior thereof; a fastening device for securing the opening; weight roll pockets along the length of the strap portion inside the pouch for receiving and holding rolls of weights; at least one additional pocket inside the pouch; a securing device for securing one end portion of the strap portion to the opposite end portion about a user's body part; and a user grasping portion comprising an elongate through hole along one end of the strap portion for accommodating the user's hand in order to use the device as a weapon;

inserting a desired number of weight rolls into the weight roll pockets;

securing the strap portion about a desired body part; and exercising wearing the weight device.

12. The method according to claim 11 wherein the providing step further comprises the step of providing a fluid containing device having a fluid inlet wherein the fluid containing device is attached to the strap portion and wherein the fluid containing device is able to receive and hold fluid filled by the user through the fluid inlet, and wherein the method further comprises the step of:

filling a desired amount of the fluid into the fluid containing device.

13. The method according to claim 12 wherein the step of providing a weight device further comprises the step of:

providing an audio unit coupled to the strap portion wherein the audio unit is able to play information.

14. The method according to claim 11 wherein the step of providing a weight device further comprises the step of:

providing an audio unit coupled to the strap portion wherein the audio unit is able to play information.

15. The method according to claim 11 wherein the wearing step further comprises the step of:

wearing the strap portion around a waist area of the user.

16. The method according to claim 11 wherein the wearing step further comprises the step of:

wearing the strap portion around a neck area of the user.

17. The method according to claim 11 wherein the wearing step further comprises the step of:

wearing the strap portion around a limb of the user.

18. An exercise weight device comprising:

a strap portion comprising an elongate pouch having a securable opening along the length thereof for accessing the interior thereof;

a fastening device for securing the opening;

a plurality of pockets along the length of the strap portion inside the pouch;

a fluid containing device within one of the pockets, said fluid containing device having a fluid inlet accessible by the user through the securable opening;

a securing device for securing one end portion of the strap portion to the opposite end portion about a user's body part; and a user grasping portion comprising an elongate through hole along one end of the strap portion for accommodating the user's hand in order to use the device as a weapon.

* * * * *